US005184734A

United States Patent [19]

Yamaguchi

[11] Patent Number: 5,184,734

[45] Date of Patent: Feb. 9, 1993

[54] SHEET DELIVERING MECHANISM

[75] Inventor: Yasuyoshi Yamaguchi, Shizuoka, Japan

[73] Assignee: Tokyo Electric Co., Ltd., Tokyo, Japan

[21] Appl. No.: 651,996

[22] Filed: Feb. 7, 1991

[30] Foreign Application Priority Data

Feb. 7, 1990 [JP] Japan ..... 2-27449

[51] Int. Cl.[5] ..... B07B 5/36; B65H 5/22

[52] U.S. Cl. ..... 209/657; 209/933; 271/3; 271/265; 271/303; 355/311

[58] Field of Search ..... 209/603, 604, 657, 933; 271/3, 4, 176, 265, 298, 303; 346/160, 160.1; 355/311, 321, 323

[56] References Cited

U.S. PATENT DOCUMENTS

| | | | |
|---|---|---|---|
| 3,283,705 | 11/1966 | Niesen et al. | 271/298 X |
| 3,589,808 | 6/1971 | Del Vecchio | 355/311 X |
| 4,333,641 | 6/1982 | Peter, III . | |
| 4,449,813 | 5/1984 | Kikuchi et al. . | |
| 4,484,734 | 11/1984 | Tsudaka et al. | 271/265 X |
| 4,727,380 | 2/1988 | Miura et al. | 355/1 X |
| 4,744,553 | 5/1988 | Hirose . | |
| 4,760,424 | 7/1988 | Ohba et al. . | |
| 4,767,172 | 8/1988 | Nichols et al. | 355/1 X |
| 4,785,319 | 11/1988 | Fujino et al. | 346/160 |
| 4,864,364 | 9/1989 | Ogino et al. | 355/202 |
| 4,875,063 | 10/1989 | Idenawa et al. | 346/160.1 |
| 4,928,150 | 5/1990 | Hatta | 355/311 |
| 4,945,390 | 7/1990 | Hasegawa et al. | 271/303 X |
| 4,968,014 | 11/1990 | Yamakoshi et al. | 209/933 X |

FOREIGN PATENT DOCUMENTS

| | | | |
|---|---|---|---|
| 56-62060 | 1/1981 | Japan | 355/311 |
| 61-138266 | 6/1986 | Japan | 346/160 |
| 01-308357 | 12/1989 | Japan | 271/303 |
| 02-127358 | 5/1990 | Japan | 271/303 |
| 1461554 | 1/1977 | United Kingdom . | |

OTHER PUBLICATIONS

"*The American Heritage Dictionary of the English Language*", William Morris, Ed., 1976.

Patent Abstracts of Japan, vol. 12, No. 346 (JP-A-6-3-106267) May 1988.

Patent Abstracts of Japan, vol. 11, No. 364 (JP-A-6-2-140970) Nov. 1987.

Patent Abstracts of Japan, vol. 13, No. 281 (JP-A--1-75352) Jun. 1989.

Patent Abstracts of Japan, vol. 10, No. 211 (JP-A-6-1-51458) Jul. 1986.

*Primary Examiner*—Donald T. Hajec

*Attorney, Agent, or Firm*—Oblon, Spivak, McClelland, Maier & Neustadt

[57] ABSTRACT

A sheet delivering mechanism guides sheets of different sizes fed from sheet feed units along a sheet guide passage including electrographic printing mechanism for printing, delivers printed sheets of different sizes to sheet receiving trays of corresponding sizes, respectively, by switching guide fingers between different guide positions according to the size of the printed sheet, so that the printed sheets are sorted by size and the printed sheets of the same size are delivered to the corresponding sheet receiving tray. The smaller sheet receiving trays for the smaller printed sheets are disposed above the larger sheet receiving trays for the larger printed sheets to facilitate taking out the printed sheets from the sheet receiving trays.

5 Claims, 2 Drawing Sheets

SHEET DELIVERING MECHANISM

FIELD OF THE INVENTION AND RELATED ART STATEMENT

The present invention relates to a sheet delivering mechanism for a business machine provided with electrographic printing means (hereinafter referred to as printing means), such as a copying machine or a laser printer, and, more particularly, to a sheet delivering mechanism for a business machine capable of printing selectively on recording sheets of different sizes.

A business machine with printing means, such as a copying machine or a laser printer, in general, prints on a sheet fed from a sheet feed unit along a sheet feed passage by the printing means, and delivers the printed sheet to a sheet receiving tray. A business machine of this kind of higher grade is provided with more sheet feed units respectively for feeding sheets of different sizes, one of the sheet feed units, for feeding sheets of a desired size is selected and sheets of the desired size is fed along the sheet feed passage.

A sheet delivering mechanism incorporated into such a business machine delivers a printed sheet being delivered along the sheet feed passage to a sheet receiving tray.

Problems in this conventional business machine will be described hereinafter. If sheets of different sizes are fed successively for printing on the business machine provided with a plurality of sheet feed units, the printed sheets of different sizes are piled in a mixed pile on the sheet receiving tray. Therefore, the printed sheets of different sizes received on the sheet receiving tray must be sorted according to size, which requires troublesome work.

A conventional sheet delivering mechanism has a side sheet receiving tray provided on one side of the business machine, an upper sheet receiving tray provided on the upper side of the business machine, and switching means for connecting a section of the sheet feed passage after the printing means to either the side sheet receiving tray or the upper sheet receiving tray to deliver the printed sheet selectively to either the side sheet receiving tray or the upper sheet receiving tray. The sheet delivery mechanism of such a construction delivers the printed sheet to the side sheet receiving tray with the printed surface facing up and to the upper sheet receiving tray with the printed surface facing down. Accordingly, the printed sheets can be piled up in a desired order by properly selecting either the side sheet receiving tray or the upper sheet receiving tray. For example, when successive pages of a book are printed, the printed sheets can be collated on the sheet receiving tray. However, even on the sheet delivering mechanism provided with a plurality of sheet receiving trays, printed sheets are delivered successively to one of the sheet receiving tray once the sheet receiving tray is selected by the switching means. Therefore, when sheets of different sizes are fed successively by the sheet feed units, printed sheets of different sizes are delivered to the selected sheet receiving tray in a mixed pile.

OBJECT AND SUMMARY OF THE INVENTION

Accordingly, it is a first object of the present invention to provide a sheet delivering mechanism capable of delivering printed sheets of the same size to a sheet receiving tray.

A second object of the present invention is to provide a sheet delivering mechanism including sheet receiving trays which enables printed sheets delivered thereto to be easily taken out therefrom.

A third object of the present invention is to provide a sheet delivering mechanism having a sufficiently high strength.

A fourth object of the present invention is to provide a sheet delivering mechanism capable of being incorporated into a compact business machine.

A fifth object of the present invention is to provide a sheet delivering mechanism of a simple construction.

A sixth object of the present invention is to provide a sheet delivering mechanism capable of sorting printed sheets of different sizes according to size without requiring any special operation.

To achieve the above objects, the present invention provides a sheet delivering mechanism for a printing business machine having a main frame, printing means supported on the main frame, and a plurality of sheet feed units respectively for feeding sheets of different sizes, comprising: a sheet guide passage extending from the sheet feed units through the printing means; a plurality of sheet receiving trays of different areas disposed one over another at intervals with the sheet receiving trays of smaller areas placed at upper positions and with the inlets thereof located near the terminal end of the sheet guide passage; a sheet guide disposed between the inlets of the sheet receiving trays and the terminal end of the sheet guide passage, and pivotally supported for turning about an axis extending in the direction of width of the sheet receiving trays; and a driving unit for turning the sheet guide to a desired position to guide a sheet to a desired sheet receiving tray. In delivering a printed sheet produced by printing an image on a sheet fed from the sheet feed unit to the sheet guide passage by the printing means to a sheet receiving tray, the sheet guide is turned to a desired position by the driving unit to guide the printed sheet selectively to a desired sheet receiving tray having an appropriate size. Accordingly, printed sheets of different sizes can readily be sorted. Furthermore, since the sheet receiving trays of smaller areas are placed over those of larger areas, printed sheets delivered to the lower sheet receiving trays are not hidden by printed sheets delivered to the upper sheet receiving trays, so that the printed sheets on the lower sheet receiving trays can easily be taken out.

DESCRIPTION OF THE PREFERRED EMBODIMENT

Figure 1:
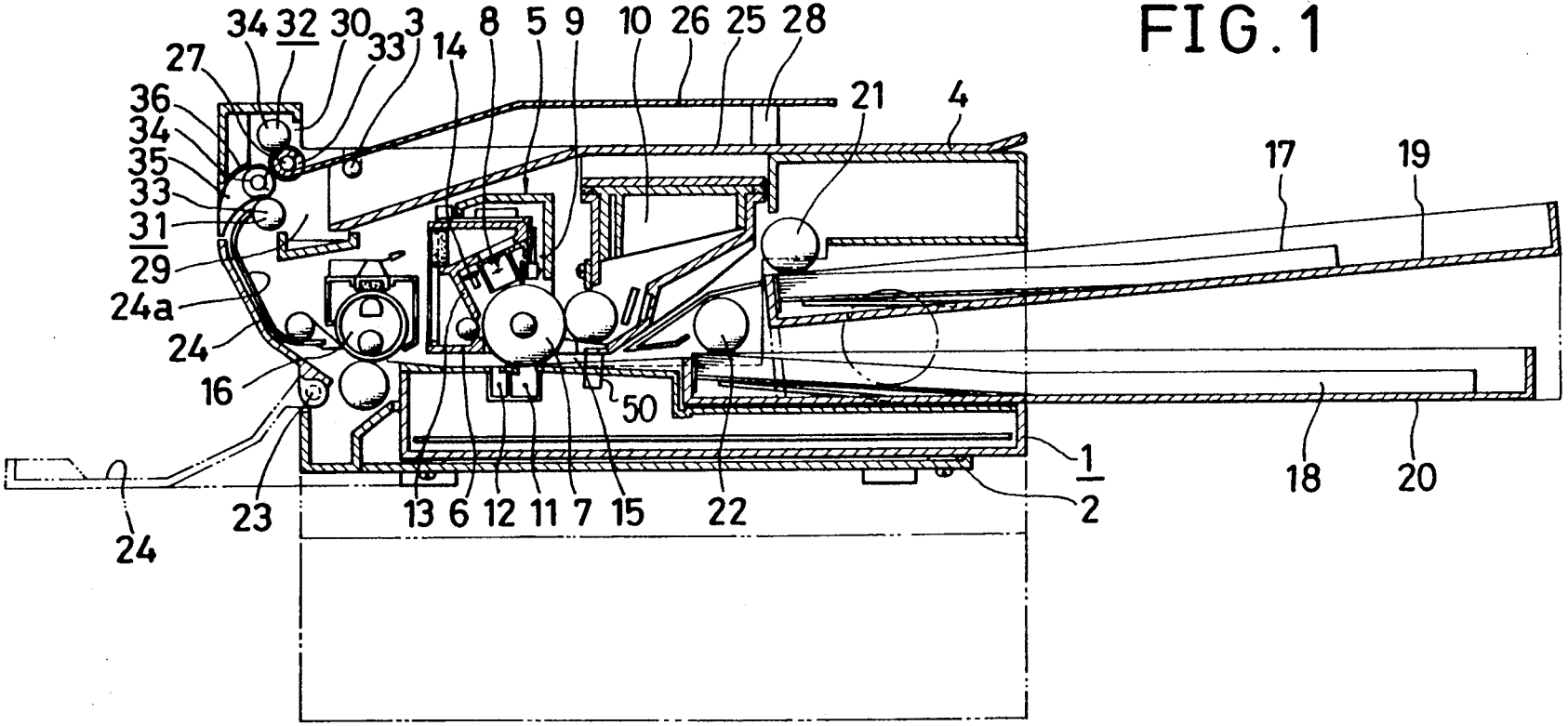
FIG. 1 is a sectional side elevation of an electrophotographic printer incorporating a sheet delivering mechanism in a preferred embodiment according to the present invention.
Figure 2:
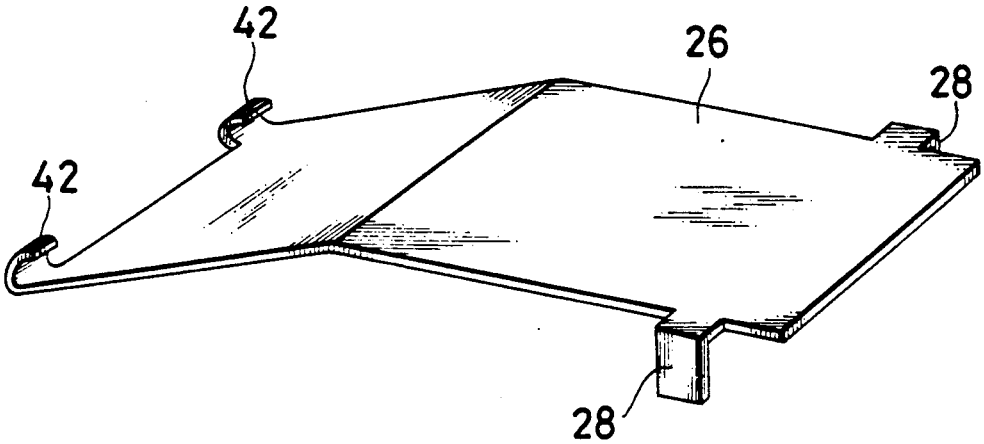
FIG. 2 is a perspective view of an upper sheet receiving tray.
Figure 3:
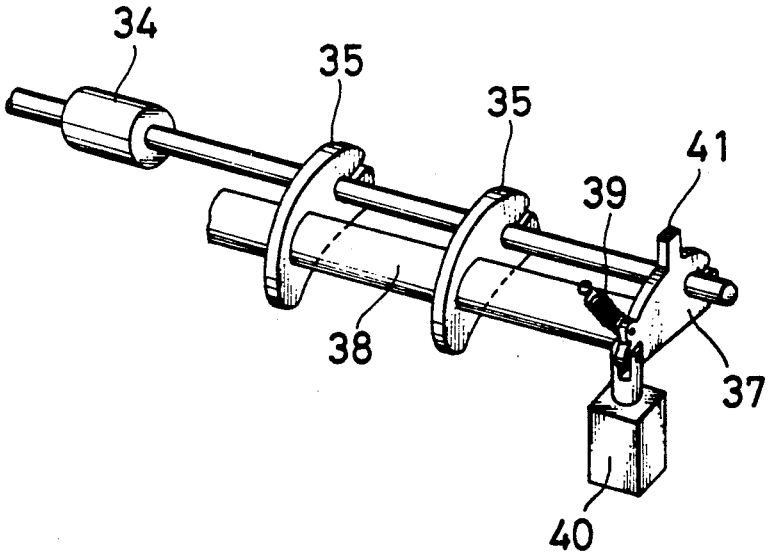
FIG. 3 is a perspective view of a sheet guide driving mechanism.

A sheet delivering mechanism in a preferred embodiment according to the present invention will be described with reference to the accompanying drawings. Referring to FIGS. 1 to 3, a main housing 1 of an electrophotographic printer consists of a lower cover 2, and an upper cover 4 pivotally and detachably joined by a pin to the lower cover 2. A printing device 5 is contained in the main housing 1. The printing device 5 comprises an image carrying member 7 supported for rotation on a support frame 6 detachably attached to the lower cover 2, a charging unit 8, an exposure unit 9 provided with a linear arrangement of a plurality of end luminous elements, a developing unit 10, a transfer unit 11, a static electricity eliminating unit 12, a cleaning unit 13, a static electricity eliminating unit 14, a sheet guide passage 15, and a fixing unit 16 disposed on the sheet guide passage 15 after the transfer unit 11. Paper cassettes 19 and 20 containing sheets 17 and 18 of different sizes are mounted detachably on one side of the main housing 1. Feed rollers 21 and 22 are disposed near the front ends of the paper cassettes 19 and 20 to feed the sheets 17 and 18 into the sheet guide passage 15, respectively. The sheet guide passage 15 has a terminal section consisting of a movable guide plate 24 pivotally supported on a pin 23 for vertical swing motion and an upswept, fixed guide plate 24*a*.

A lower sheet receiving tray 25 is formed integrally with the upper wall of the upper cover 4 of the main housing 1. An upper sheet receiving tray 26 of a length shorter than that of the lower sheet receiving tray 25 is supported for swing motion in a vertical plane by a shaft 27 on the upper cover 4. Spacing legs 28 are formed in the opposite sides of the free end of the upper sheet receiving tray 26 so as to rest on the opposite sides of the upper cover 4, respectively. Sheet delivery openings 29 and 30 are formed in the upper portion of the main housing 1 opposite to the inlet ends of the sheet receiving trays 25 and 26, respectively. A lower sheet delivering unit 31 and an upper sheet delivering unit 32 are disposed near the sheet delivery openings 29 and 30, respectively. Each of the sheet delivering units 31 and 32 is provided with a lower delivery roller 33 and a top delivery roller 34 placed in parallel to and in contact with the lower delivery roller 33. Gears, not shown, fixed to the shafts of the delivery rollers 33 and 34 of the sheet delivering units 31 and 32 on one side of the main housing 1 are meshed sequentially in a gear train so that all the delivery rollers 33 and 34 rotate simultaneously when one of the gears is rotated by a motor. The axis of the bottom delivery roller 33 of the upper sheet delivering unit 32 is offset toward the sheet receiving trays 25 and 26 relative to the axis of the top delivery roller 34 of the lower sheet delivering unit 31 in order that the delivery rollers 33 and 34 can be accommodated in a space of a height smaller than that of a space necessary for accommodating the delivery rollers 33 and 34 when the axes of the delivery rollers 33 and 34 are arranged in a vertical plane. A plurality of guide fingers 35 are supported for swing motion about an axis coinciding with the axis of the top delivery roller 34 of the lower sheet delivering unit 31. A plurality of guide ribs 36 for guiding sheets 17 and 18 are formed in the upper portion of the main housing 1 respectively opposite to the backsides of the guide fingers 35.

As shown in FIG. 3, the guide fingers 35 are connected by a connecting rod 38 to a lever 37. The lever 37 is biased upward by a spring 39, and an electromagnetic actuator 40 is connected to the extremity of the lever 37. A projection 41 is formed on the upper edge of the lever 37 so as to come into contact with part of the main housing 1 when the lever 37 is biased upward to limit the upward swing of the lever 37. When the electromagnetic actuator 40 is actuated, the lever 37 is turned downward to turn the guide fingers 35 downward.

Referring to FIG. 2, knuckles 42 are formed on the opposite sides, respectively, of one end of the upper sheet receiving tray 26. The knuckles 42 engage elastically the shaft 27 of the bottom roller 33 of the upper sheet delivering unit 32.

The charging unit 8 charges the circumference of the image carrying member 7, the exposure unit 9 scans the charged circumference of the image carrying member 7 with a light ray to form an electrostatic latent image on the circumference of the image carrying member 7 and the developing unit 10 develops the electrostatic latent image in a visible image for every one full turn of the image carrying member 7. On the other hand, the feed roller 21 feeds a sheet 17 from the paper cassette 19 or the feed roller 22 feeds a sheet 18 from the paper cassette 20 to an image transfer position between the image carrying member 7 and the transfer unit 11, the transfer unit 11 transfers the visible image to the sheet 17 or 18, the static electricity eliminating unit 12 eliminates static electricity from the sheet 17 or 18, the fixing unit 16 fixes the visible image on the sheet 17 or 18, and then the sheet 17 or 18 is delivered to the sheet receiving tray 25 or 26.

FIG. 1 shows the electrophotographic printing machine set for printing on a larger sheet 18, in which the guide fingers 35 are held at the upper position to guide the sheet 18 delivered from the fixing unit 16 along the arcuate lower edges to the delivery rollers 33 and 34 of the lower sheet delivering unit 31 to deliver the sheet 18 through the sheet delivery opening 29 to the lower sheet receiving tray 25. When the paper cassette 19 is selected to use the smaller sheet 17, the electromagnetic actuator 40 is actuated to shift the guide fingers to the lower position by turning the lever 37 downward. Consequently, the the sheet guide passage leading to the lower sheet delivering unit 31 is closed by the guide fingers 35, the sheet 17 is guided between the upper edges of the guide fingers 35 and the arcuate lower edges of the guide ribs 36 to the delivery rollers 33 and 34 of the upper sheet delivering unit 32 to deliver the sheet 17 through the upper sheet delivery opening 30 to the upper sheet receiving tray 26. Accordingly, even if both the smaller sheets 17 and the larger sheets 18 are used succesively, the smaller sheets 17 and the larger sheets 18 are sorted from each other and are delivered separately to the upper sheet receiving tray 26 and to the lower sheet receiving tray 25, respectively. A sheet detector 50 is provided in the sheet guide passage 15 to identify the sheets 17 and 18, and the operation of the electromagnetic actuator 40 is controlled according to a detection signal provided by the sheet detector so that the guide fingers 35 are turned automatically to the upper position for delivering the larger sheet 18 to the lower sheet receiving tray 25 or to the lower position for delivering the smaller sheet 17 to the upper sheet receiving tray 26. When the electromagnet of the electromagnetic actuator 40 is de-energized, the guide fingers 35 are turned by the spring 39 to the upper position, i.e., the initial position, to deliver the larger sheet 18 to the lower sheet receiving tray 25. The guide finger control means comprising the spring 39 and the electromagnetic actuator 40 is simple in construction.

Since the larger sheets 18 are delivered to the lower sheet receiving tray 25 and the smaller sheets 17 are delivered to the upper sheet receiving tray 26, the sheets 18 stored on the lower sheet receiving tray 25 are not hidden by the sheets 17 stored on the upper sheet receiving tray 26, so that the sheets 17 and 18 can easily be taken out from the upper sheet receiving tray 26 and the lower sheet receiving tray 25.

The spacing legs 28 formed in the opposite sides of the free ends of the upper sheet receiving tray 26 supported for swing motion on the shaft 27 of the delivery roller 33 rest on the upper wall of the upper cover 4 to support the upper sheet receiving tray 26 securely on the upper cover 4, so that the upper sheet receiving tray 26 is not deformed by the weight of the sheets 17 stored thereon.

The moveable guide plate 24 set at a position indicated by imaginary lines in FIG. 1 serves as a sheet receiving tray.

What is claimed is:

1. A sheet delivering mechanism comprising:

a main housing comprising electrographic printing means;

a plurality of sheet feed units mounted on the main housing and respectively containing sheets of different sizes;

a sheet guide passage extending from the sheet feed units through the electrographic printing means;

a plurality of sheet receiving trays of different sizes disposed in layers with intervals therebetween, the smaller sheet receiving trays being disposed above the larger sheet receiving trays, each of said plurality of sheet receiving trays having an input end, said sheet guide passage extending to and ending at said input ends of said plurality of sheet receiving trays;

guide fingers arranged between the input ends of the sheet receiving trays and the end of the sheet guide passage and supported for turning about an axis extending along the direction of the widths of the sheet receiving trays; and a driving unit for turning the guide fingers;

wherein a plurality of sheet delivering units each consisting of a top delivery roller and a bottom delivery roller are disposed between the respective input ends of the sheet receiving trays and the end of the sheet guide passage, the axis of the bottom delivery roller of the upper sheet delivering unit is offset toward the sheet receiving trays relative to the axis of the upper delivery roller of the lower sheet delivering unit.

2. A sheet delivering mechanism according to claim 1, wherein the end of the sheet guide passage beyond the electrographic printing means is extended upward, an upper wall of the main housing is used as the larger sheet receiving tray, the smaller sheet receiving tray is supported pivotally at one end thereof on an upper portion of the main housing, and the smaller sheet receiving tray is provided in the opposite sides of the free ends thereof with spacing legs that rest on the upper wall of the main housing.

3. A sheet delivering mechanism according to claim 1, wherein the guide fingers are biased in one turning direction by a spring, and said driving unit turns the guide fingers in the other turning direction.

4. A sheet delivering mechanism according to claim 1, wherein a sheet detector for identifying the type of a sheet is provided on the sheet guide passage, and the guide fingers are switched from one position to another by guide finger switching means according to a detection signal provided by the sheet detector.

5. A sheet delivering mechanism comprising:

a main housing having an electrographic printing means disposed therein;

a plurality of sheet feed units mounted on the main housing and respectively containing sheets of different sizes;

first and second sheet receiving trays, said first sheet receiving tray receiving large size sheets and said second sheet receiving tray being smaller in size than said first sheet receiving tray and receiving small size sheets, wherein an upper surface of said main housing defines said first sheet receiving tray and said second sheet receiving tray is disposed vertically on and above said first sheet receiving tray, each of said sheet receiving trays having an input end;

a sheet guide passage extending from the sheet feed units through the electrographic printing means and to the input ends of the first and second sheet receiving trays; and guide means disposed between the input ends of the first and second sheet receiving trays and the sheet guide passage for selectively guiding a sheet from the sheet guide passage to one of said first and second sheet receiving trays.

* * * * *